United States Patent [19]

Eising

[11] 4,301,772

[45] Nov. 24, 1981

[54] WATER HEATING APPARATUS

[75] Inventor: John P. Eising, Oconomowoc, Wis.

[73] Assignee: A. O. Smith Corporation, Milwaukee, Wis.

[21] Appl. No.: 155,388

[22] Filed: Jun. 2, 1980

[51] Int. Cl.[3] ..... F22B 5/00

[52] U.S. Cl. ..... 122/17; 126/361; 431/116

[58] Field of Search ..... 122/17, 14, 19; 126/361; 431/352, 116

[56] References Cited

U.S. PATENT DOCUMENTS

| | | | |
|---|---|---|---|
| 2,790,428 | 4/1957 | Buttler | 122/17 |
| 3,131,749 | 5/1964 | Davis | 431/352 |
| 3,349,754 | 10/1967 | Bock | 122/17 |
| 4,257,355 | 3/1981 | Cook | 122/17 |

FOREIGN PATENT DOCUMENTS

| | | | |
|---|---|---|---|
| 486936 | 11/1929 | Fed. Rep. of Germany | 122/17 |
| 2829039 | 1/1980 | Fed. Rep. of Germany | 122/17 |

*Primary Examiner*—Edward G. Favors

*Attorney, Agent, or Firm*—Andrus, Sceales, Starke & Sawall

[57] ABSTRACT

A water heating apparatus includes a tank that contains the liquid to be heated and a casing serving as a combustion chamber disposed within the tank and extending slightly beyond the cylindrical shell of the tank. The casing is disposed in the tank at an angle so as to slope downwardly and through the shell. This slope allows for the run-off of condensate which forms as a by-product of combustion. The combustion chamber casing also includes a baffle assembly disposed within the casing. The baffle assembly defines a series of passageways with ever decreasing cross-sectional areas that force the combustion gases to accelerate as they move from the combustion zone to the flue.

3 Claims, 4 Drawing Figures

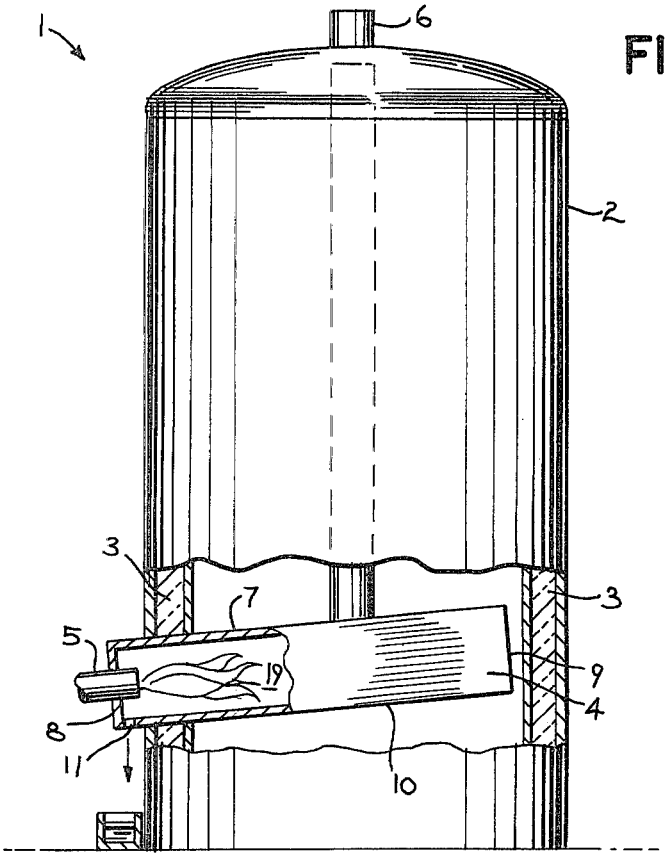
FIG. 1
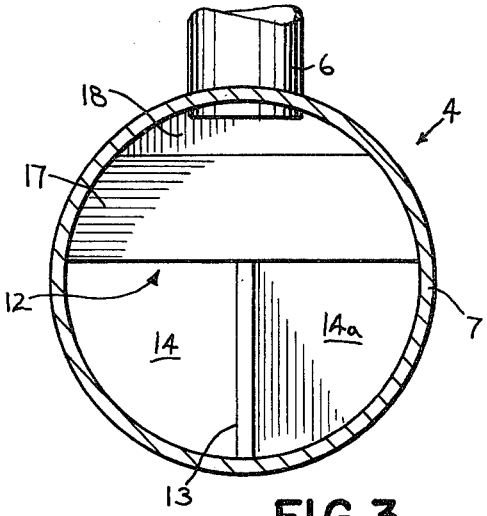
FIG. 3
FIG. 2
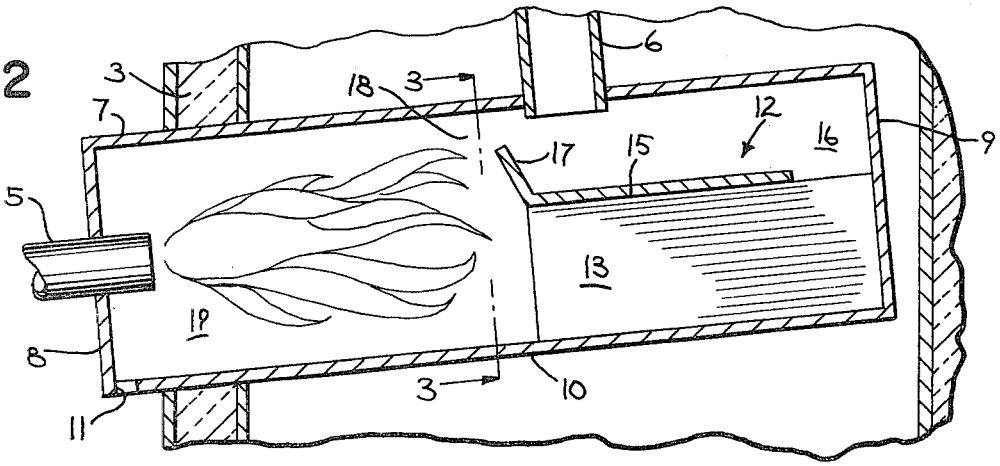
FIG. 4
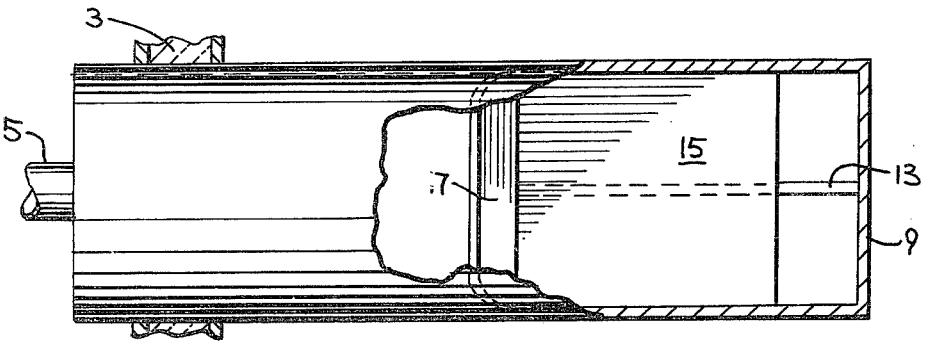

WATER HEATING APPARATUS

BACKGROUND OF THE INVENTION

This invention relates to a water heating apparatus and more specifically to such combustion chambers used in such water heaters.

In gas water heaters liquid condensate is produced as a natural by-product of the combustion process. In the past this condensate has been collected in the combustion chamber, e.g. U.S. Pat. No. 2,480,657 to Jones and U.S. Pat. No. 2,650,575 to Carlson, where it is vaporized by the gas flame.

However, in high efficiency water heaters, vaporization of the condensate is not desirable. Since the heat of vaporization is approximately 540 cal./gm., each gram of condensate that is changed to steam consumes 540 calories of heat that could otherwise be used to heat the water in the tank. In high efficiency systems this waste cannot be tolerated.

Also in the past combustion chambers, such as that shown in U.S. Pat. No. 2,480,657 to Jones, consisted of a cylindrical casing that contained the combustion flame and a vertical flue leading up from the combustion chamber.

However, it has been found that the amount of heat transferred from the combustion chamber to the surrounding water in the tank is proportional to the speed of the combustion gases as they travel from the ignition area to the flue. Therefore it is desirable to accelerate the combustion gases as they journey towards the flue.

SUMMARY OF THE INVENTION

A water heating apparatus includes a tank that contains the liquid to be heated and a combustion chamber casing disposed within the lower end of the tank and extending laterally beyond the shell of the tank. The bottom surface of the casing located beyond the shell has a drainage port for the elimination of condensate from the chamber.

The casing is disposed in the water heater at an angle so as to slope downwardly toward the drainage port so that condensate collecting in the chamber will be discharged through the drainage port.

The combustion chamber also includes a baffle assembly disposed within the casing. The baffle assembly defines a series of passageways through which the combustion gases must flow on their way to the flue. Each successive passageway has a cross-sectional area smaller than that of the passageway immediately preceding it, so that the combustion gases are forced to accelerate as they travel through the casing toward an eventual exit via the flue.

The present invention thus provides a combustion chamber that removes collected condensate to an area remote from the combustion; thus eliminating the waste of heat caused by the vaporization of the condensate.

The present invention also provides a combustion chamber that utilizes a baffle assembly to accelerate the combustion gases and thus increases the efficiency of the heat transfer process.

BRIEF DESCRIPTION OF THE DRAWINGS

The drawings illustrate the best mode presently contemplated of carrying out the invention.

In the drawings:

FIG. 1 is a side elevational with parts broken away of a water heater incorporating the combustion chamber of the invention;

FIG. 2 is an enlarged fragmentary view of the combustion chamber;

FIG. 3 is a section taken along line 3—3 of FIG. 2; and

FIG. 4 is a plan view of the combustion chamber with parts broken away.

DESCRIPTION OF THE PREFERRED EMBODIMENT

As is shown in FIG. 1, a gas water heater 1 includes a generally cylindrical tank 2 having an insulated shell 3. Inlet and outlet pipes (not shown) supply fresh water to the tank and remove heated water for use.

A combustion chamber casing 4 is disposed within tank 2 and extends laterally slightly beyond shell 3. A gas and air mixture is introduced into chamber 4 via pipe 5. The mixture is ignited by a pilot (not shown) and the combustion gases flow through chamber 4 and exit through flue 6.

The combustion chamber itself consists of a generally cylindrical casing 7 having a front wall 8 and a rear wall 9. The lower surface of casing 7 has a drainage port 11 adjacent front wall 8.

As can be seen in FIG. 2, casing 7 is disposed within tank 2 at approximately a 5° angle. This downward slope permits condensates which form in flue 6 and chamber 4 to flow to the outside of tank 2 and exit through drainage port 11.

Combustion chamber 4 also includes baffle assembly 12. Baffle assembly 12 includes a support member 13 which engages the lower surface of the casing and abuts rear wall 9. Support member 13 defines a pair of lower longitudinal passageways 14 and 14*a* within casing 7.

Connected to support member 13 is a plate 15 which engages the sides of casing 7. Plate 15 extends rearwardly to a point short of rear wall 9 and defines an upper longitudinal passageway 16.

Deflection plate 17 is connected to plate 15 and extends upwardly while sloping toward front wall 8. Deflection plate 17 stops short of contacting the casing wall and thus creates a gap 18 through which combustion gases may flow.

Gap 18 is allowed to exist between casing 7 and deflection plate 17 since it is impossible to force all of the hot gases downward in chamber 4 and some quantity must be allowed to pass along the top of chamber 4.

Baffle assembly 12 is designed in such a way that passageways 14 and 14*a* have a smaller cross-sectional area than primary combustion zone 19 and passageway 16 has a cross-sectional area smaller than that of passageways 14 and 14*a*.

Thus as the hot gases are produced in combustion zone 19 they encounter deflection plate 17. Some of the hot gases pass through gap 18 and exit through flue 6, but a majority of the hot gas is forced downward in the chamber and through passageways 14 and 14*a*. Deflection plate 17 also creates turbulence in the combustion gases thus causing a scrubbing action which results in a more efficient heat transfer process.

As the gases exit passageways 14 and 14*a*, they must enter narrower passageway 16 before exiting through flue 6. The flow of the combustion gases through passages of ever decreasing cross-sectional areas causes an increase in the velocity of the gases which results in a more efficient heat exchange process.

Various modes of carrying out the invention are contemplated as being within the scope of the following claims, particularly pointing out and distinctly claiming the subject matter which is regarded as the invention.

I claim:

1. A heating apparatus comprising:

a. a tank to contain liquid to be heated;

b. a casing disposed within said tank and defining a combustion zone;

c. combustion means disposed within said casing;

d. a flue connected to said casing to evacuate combustion gases from said tank;

e. a first baffle member disposed within said casing and defining a pair of longitudinal passageways in said casing; and f. a second baffle member connected to said first baffle member and defining with the upper portion of said casing an upper passageway in said casing, said upper passageway communicating with said flue and with said longitudinal passageways, said upper passageway having a cross-sectional area less than the cross-sectional area of said longitudinal passageways.

2. The heating apparatus of claim 1 further comprising a deflection member disposed within said casing to deflect the combustion gases toward the bottom of said casing and through said longitudinal passageways.

3. A heating apparatus comprising:

a. a tank to contain liquid to be heated;

b. a casing disposed within said tank and defining a combustion zone; said casing having a front and rear wall connected by a sidewall;

c. combustion means disposed within said casing;

d. a flue connected to said casing to evacuate combustion gases from said tank; and e. a baffle assembly disposed within said casing including:

i. a support member engaging the bottom surface of said casing sidewall and abutting said rearwall, the upper edge of said support member being slightly above the longitudinal axis of said casing and the front edge of said support member extending into the approximate center of said casing; said support member defining a pair of longitudinal passageways in said casing;

ii. a plate member connected to the upper edge of said support member and disposed substantially perpendicular to said support member, said plate member extending from the front edge of said support member to a point short of said rearwall and defining with the upper portion of said casing an upper passageway in said casing; and iii. a deflection member connected to and extending upwardly from the front edge of said plate member to a point short of the upper surface of said casing sidewall, said deflection member sloping toward the front wall of said casing to deflect the combustion gases toward the bottom of said casing and through said longitudinal passageways.

* * * * *